US005285851A

United States Patent [19]

Pringle

[11] Patent Number: 5,285,851

[45] Date of Patent: Feb. 15, 1994

[54] COILED TUBING SAFETY VALVE AND ASSEMBLY

[75] Inventor: Ronald E. Pringle, Houston, Tex.

[73] Assignee: Camco International Inc., Houston, Tex.

[21] Appl. No.: 929,877

[22] Filed: Aug. 12, 1992

[51] Int. Cl.[5] ..... E21B 34/12

[52] U.S. Cl. ..... 166/326

[58] Field of Search ..... 166/55.1, 66, 72, 113, 166/295, 291, 129, 384, 387, 372, 373, 385, 336, 381, 325, 326

[56] References Cited

U.S. PATENT DOCUMENTS

| | | | |
|---|---|---|---|
| 4,125,162 | 11/1978 | Groves, Sr. et al. | 166/372 |
| 4,473,122 | 9/1984 | Tamplen | 166/381 |
| 4,658,904 | 4/1987 | Doremus et al. | 166/336 |
| 4,844,166 | 7/1989 | Going, III et al. | 166/77 |
| 4,923,012 | 5/1990 | Hopmann | 166/325 |
| 5,020,600 | 6/1991 | Coronado | 166/387 |
| 5,180,012 | 1/1993 | Crawford | 166/384 |
| 5,207,275 | 5/1993 | Strattan et al. | 166/129 |
| 5,211,243 | 5/1993 | Strattan et al. | 166/129 |

OTHER PUBLICATIONS

Drawing 21449-000-00000 of Camco, Inc., dated Jun. 1981, entitled R-20 Safety Valve.

Co-pending application Ser. No. 07/840,254 filed Feb. 24, 1992 entitled "Coiled Tubing Gas Lift Assembly".

*Primary Examiner*—Ramon S. Britts
*Assistant Examiner*—Frank S. Tsay
*Attorney, Agent, or Firm*—Fulbright & Jaworski

[57] ABSTRACT

A flexible subsurface well safety valve for installation in the interior of a coiled tubing. A coiled tubing member is connected in a coiled tubing and a safety valve, which is flexible for allowing bending about its longitudinal axis, is positioned in the bore of the tubular member. The valve has sufficient flexibility to coil around a coiled tubing reel. The safety valve includes a housing with a hydraulic piston and cylinder assembly coaxially positioned above the housing and a biasing spring coaxially positioned above the housing and connected to the hydraulic means.

14 Claims, 2 Drawing Sheets

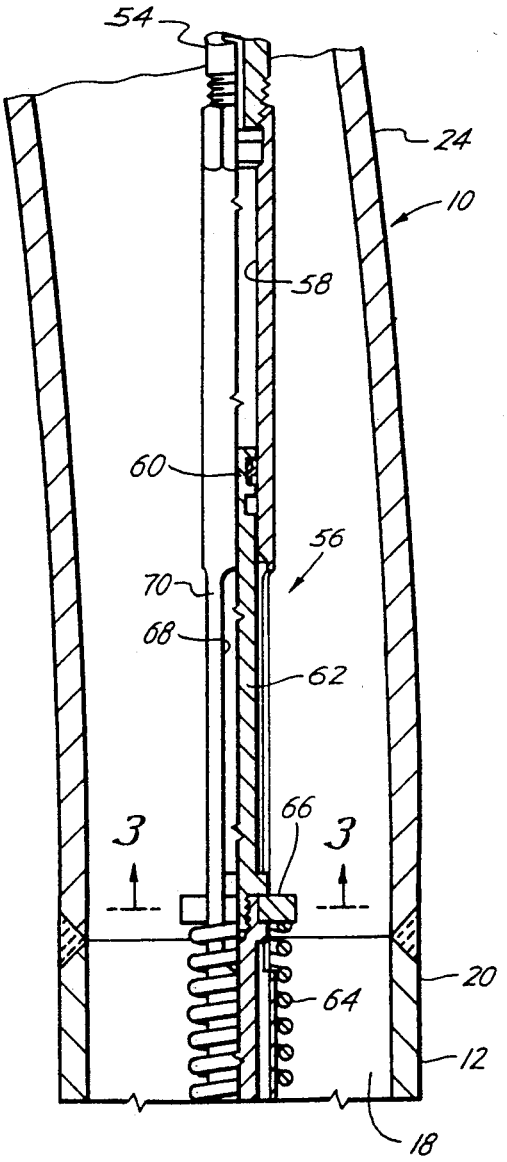
Fig. 1A
Fig. 1B
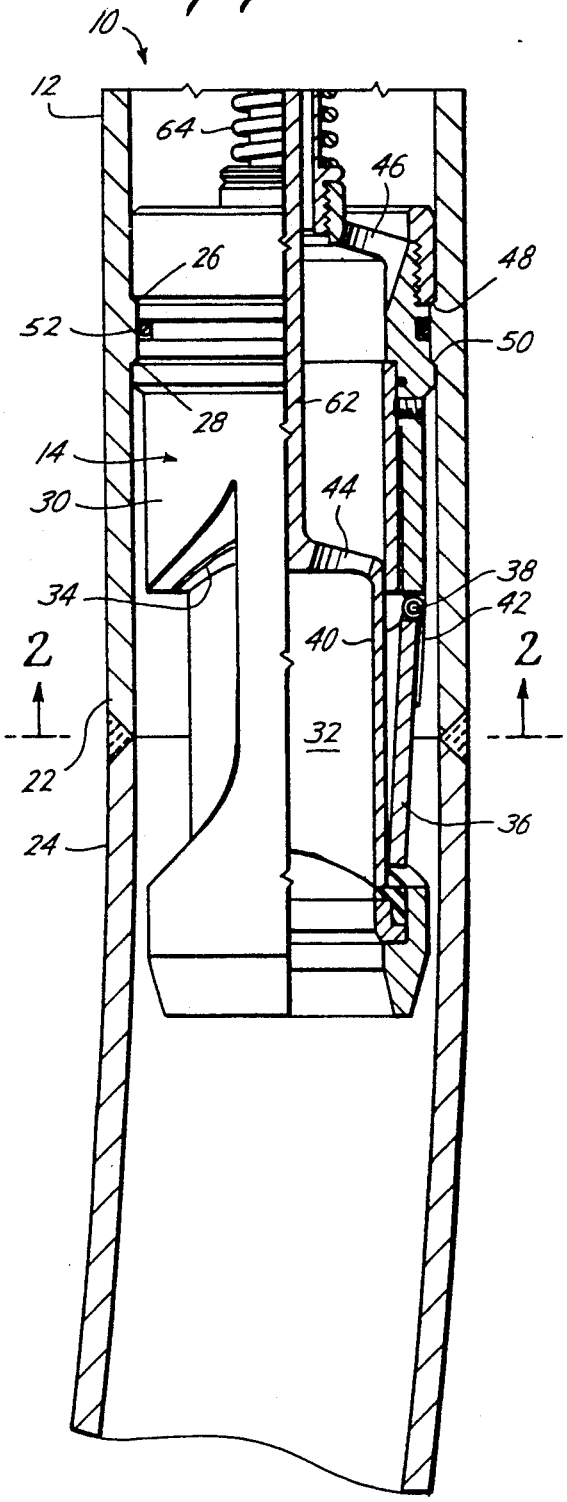

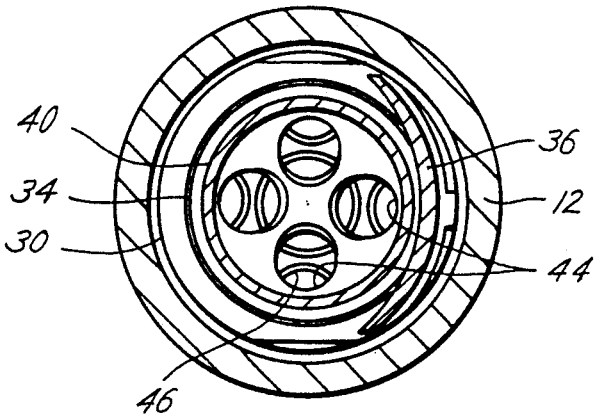
Fig. 2
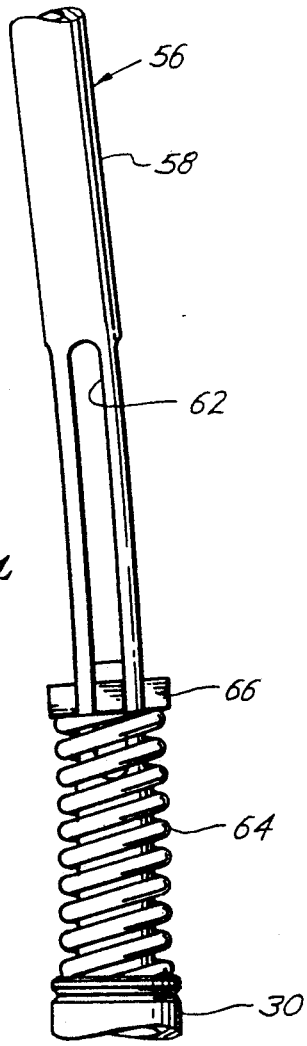
Fig. 4
Fig. 3
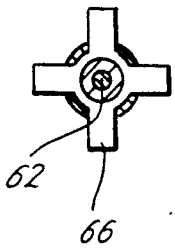

COILED TUBING SAFETY VALVE AND ASSEMBLY

BACKGROUND OF THE INVENTION

Coiled tubing is utilized in oil and/or gas wells by being reeled into and out of a production tubing string for performing many types of operations. For example, see U.S. Pat. No. 4,844,166 and co-pending application Ser. No. 07/840,254, filed Feb. 24, 1992 entitled "Coiled Tubing Gas Lift Assembly."

Coiled tubing has the advantage of conducting various operations in oil and/or gas wells without requiring the use of a rig. However, coiled tubing has a limitation in that it must be capable of being wound and stored on a coiled tubing reel, and capable of being injected through wellhead equipment which distorts the coiled tubing. Consequently these limitations restrict the use of various well tools.

The present invention is directed to a coiled tubing safety valve and assembly in which a flexible safety valve is mounted internally of the coiled tubing. This has the advantage that the safety valve and coiled tubing can be stored on coiled tubing reels, and may be injected through wellhead equipment.

SUMMARY OF THE INVENTION

The present invention is directed to a coiled tubing safety valve and assembly which includes a coiled tubing tubular member having a bore therethrough and having first and second ends connected in a coiled tubing. A safety valve is positioned in the bore and the valve is flexible for allowing bending about its longitudinal axis. Holding means are provided in the bore for engaging and holding the flexible safety valve in the bore.

Still a further object of the present invention is wherein the safety valve includes a housing having a passageway and a valve closure member in the passageway moving between opened and closed positions for controlling fluid flow through the passageway. A flow tube is telescopically movable in the housing for controlling the movement of the valve closure member and fluid actuating means is coaxially positioned with and connected to the flow tube.

Still a further object of the present invention is wherein the fluid actuating means is a hydraulic piston and cylinder assembly which is flexible along its longitudinal axis and is positioned above the housing thereby allowing the safety valve to bend about its longitudinal axis and be coiled around a coiled tubing reel.

Yet a still further of the present invention is the provision of biasing spring means coaxially positioned above the housing and surrounding the fluid actuating means.

Yet a further object is wherein the housing includes flow ports at the top of the housing in communication with the passageway.

Still a further object of the present invention includes a hydraulic control line connected to the fluid actuating means and positioned coaxially of the coiled tubing member.

Still a further object of the present invention is wherein the length of the flow tube is only slightly longer than the width of the valve closure member thereby allowing the housing to be made shorter than conventional housings.

Still a further object is wherein the flow tube includes a coaxially connection to the fluid actuating means.

Yet a still further object is wherein the hydraulic means includes a single coaxially piston which is connected to the biasing spring means.

Other and further objects, features and advantages will be apparent from the following description of a presently preferred embodiment of the invention, given for the purpose of disclosure, and taken in conjunction with the accompanying drawings.

BRIEF DESCRIPTION OF THE DRAWINGS

FIGS. 1A and 1B are continuations of each other and forms an elevational view, in quarter section, of the present invention, FIG. 2 is a cross sectional view taken along the line 2—2 of FIG. 1B, FIG. 3 is a cross sectional view taken along the line 3—3 of FIG. 1A, and FIG. 4 is an enlarged fragmentary elevational view illustrating the flexibility of a portion of the safety valve of the present invention.

DESCRIPTION OF THE PREFERRED EMBODIMENT

Referring now to the drawings, and particularly to FIGS. 1A and 1B, the reference numeral 10 generally indicates the coiled tubing safety valve assembly of the present invention and generally includes a coiled tubing tubular member 12 having a bore 18 therethrough and having a first end 20 and a second end 22 connected in a coiled tubing 24. In the case of supplying a coiled tubing assembly ready to run continuously, the preferred method of coupling the member 12 to the coiled tubing 24 is by full penetration welding of the ends 20 and 22 into the coiled tubing 24. Preferably the tubular member 12 has substantially the same outside diameter and substantially the same thickness as the coiled tubing 24, which is advantageous in coiling the assembly on a coiled tubing reel and for ease of feeding the coiled tubing 24 through wellhead equipment such as an injector.

Holding means are provided in the bore 18 for engaging and holding a flexible safety valve 14 in the bore 18. Preferably the holding means includes an upwardly facing shoulder 26 and a downwardly facing shoulder 28, both of which can be engaged by the safety valve 14.

The flexible safety valve 14 includes a housing 30 which is adapted to be positioned in the bore 18 of the tubular member 12 to permit well production there through under normal operating conditions, but in which the safety valve 14 may close or be closed in response to abnormal conditions.

The housing 30 includes a passageway 32 in communication with the bore 18, an annular valve seat 34 positioned about the passageway 32, a valve closure element such an arcuate flapper valve element 36, such as more fully described in U.S. Pat. No. 4,926,945, connected to the housing 30 by pivot pin 38. Thus when the flapper valve 36 is in an upward position and seated on the valve seat 34, the safety valve 14 is closed blocking flow upwardly through the bore 18 and the coiled tubing 24.

A longitudinal flow tube 40 is telescopically movable in the housing 30 and through the valve seat 34. As best seen in FIG. 1B, when the flow tube 40 is moved to a downward position, the tube 40 pushes the flapper 36 away from the valve seat 34. Thus, the valve 14 is held in the open position so long as the flow tube 40 is in the downward position. When the flow tube 40 is moved upwardly, the flapper 36 is allowed to move upwardly onto the seat 34 by the action of a spring 42.

With the valve 14 in the open position as shown, fluid flows from the coil tubing 24 up through the passageway 32 through ports 44 in the flow tube 40 and through ports 46 in the housing 30 and into the bore 18 of the tubular member 12.

The valve 14 includes locking shoulders 48 and 50 to coact with the holding shoulders 26 and 28, respectively, for holding the safety valve 14 in the tubular member 12. Seal means 52 provides a seal between the interior of the tubular member 12 and the valve housing 30.

First, it is to be noted that the length of the housing 30 of the flexible safety valve 14 is small enough so that it may be wound upon a conventional coiled tubing reel. Secondly, the length of the flow tube 40 is only slightly longer than the outside diameter of the flapper valve 36 which allows the housing 30 to be made considerably shorter than conventional safety valve housings.

In addition, the flexible safety valve 14 includes fluid actuating means 56 and biasing means 64 such as a spring, but these components are positioned out of the housing 30 and are made flexible and avoid lengthening the housing 30.

The flexible safety valve 14 is controlled by the application or removal of a pressurized fluid, such as hydraulic fluid, through a control line such as control line 54 which is preferably inside of the coiled tubing 24 although it could be connected from an exterior line and extend through a port into the safety valve 14. The control line 54 is connected to a fluid actuating means such as a piston and cylinder assembly 56 which includes a cylinder 58 and a piston 60, one of which, here shown as the piston 60, is connected to a piston rod 62 which is in turn connected to the top of the flow tube 40. Thus, the flow tube 40 has a coaxial connection to the piston and cylinder assembly 56.

A biasing spring 64 is provided between the housing 30 and a connection 66 attached to the piston rod 62 for biasing the flow tube 40 upwardly for allowing the flapper valve 36 to close. The connection 66 may be an X-shaped member movable through windows 68 in a support 70.

The safety valve 14 is controlled by the application or removal of pressurized hydraulic fluid through the control line 54. When pressurized fluid is supplied to the piston cylinder assembly 56, the piston 60 moved downwardly moving the flow tube 40 downwardly to open the valve 14. When hydraulic pressure is vented from the control line 54, the biasing spring 64 moves the piston rod 62 and the flow tube 40 upwardly to allow the valve 14 to close.

Referring now to FIG. 4, it is to be noted that the positioning of the biasing spring 64, and the hydraulic piston and cylinder assembly 56 outside of the housing 30 provides a structure which not only shortens the overall length of the body 30, but provides flexibility to the safety valve 14 by allowing it to bend about its longitudinal axis so as to be reeled onto and off of coiled tubing reels. Furthermore, the structure shown allows a single spring 64 to be used of any desired length. This provides a flexible safety valve 14 having greater setting depths and still provide a valve which may be flexibly bent. While various types of materials may be used such as plastics, it is preferable that the spring 64 and the cylinder 58 be of metal. It is also noted that the control line 54 and hydraulic piston and cylinder assembly 56 are in tension and thus can be made thin and flexible.

The present invention, therefore, is well adapted to carry out the objects and attain the ends and advantages mentioned as well as others inherent therein. While presently preferred embodiment of the invention has been given for the purpose of disclosure, numerous changes in the details of construction and arrangement of parts, will readily suggest themselves to those skilled in the art, and which are encompassed within the spirit of the invention and the scope of the appended claims.

What is claimed is:

1. A coiled tubing safety valve assembly comprising, a coiled tubing tubular member having a bore therethrough and having first and second ends connected in a coiled tubing, a safety valve, said valve including a housing having a passageway and a valve closure member in the passageway moving between open and closed positions for controlling fluid flow through the passageway, a flow tube telescopically moving in the housing for controlling the movement of the valve closure member, and hydraulic piston and cylinder fluid actuating means positioned above and connected to the flow tube, and a hydraulic control line connected to the hydraulic actuating means and extending upwardly, and at least some of the parts of the safety valve being flexible for allowing bending about its longitudinal axis and said safety valve positioned in the bore, and holding means in the bore for engaging and holding the flexible safety valve in the bore.

2. The assembly of claim 1 wherein the fluid actuating means is positioned above the housing.

3. The assembly of claim 2 wherein the safety valve includes, biasing spring means coaxially positioned above the housing and surrounding the fluid actuating means.

4. The assembly of claim 1 wherein said housing includes flow ports at the top of the housing in communication with the passageway.

5. The assembly of claim 1 wherein the hydraulic control line is positioned coaxially of the coiled tubing member.

6. The assembly of claim 1 wherein the length of the flow tube is only slightly larger than the width of the valve closure member.

7. The assembly of claim 1 wherein the flow tube includes a coaxial connection to the fluid actuating means.

8. The assembly of claim 1 wherein the hydraulic piston and cylinder means is flexible for allowing bending about the longitudinal axis of the hydraulic means.

9. A flexible safety valve for inserting in coil tubing comprising, a housing having a passageway, a valve closure member in the passageway moving between open and closed positions for controlling fluid flow through the passageway, a flow tube telescopically moving in the housing for controlling the movement of the valve closure member, a hydraulic piston and cylinder means coaxially positioned above the housing and connected to the flow tube, a hydraulic control line connected to the hydraulic means and extends upwardly with the coil tubing, and biasing spring means coaxially positioned above the housing and connected to the hydraulic means.

10. The assembly of claim 9 wherein the hydraulic means includes a single coaxial piston.

11. The assembly of claim 10 wherein the spring surrounds the hydraulic means and is connected to the piston.

12. The assembly of claim 9 wherein the housing includes flow ports at the top of the housing in communication with the passageway.

13. The assembly of claim 9 wherein the length of the flow tube is only slightly larger than the width of the valve closure member.

14. The assembly of claim 9 wherein the hydraulic piston and cylinder means is flexible for allowing bending about the longitudinal axis of the hydraulic means.

* * * * *